US007806564B2

(12) United States Patent
Liang

(10) Patent No.: US 7,806,564 B2
(45) Date of Patent: Oct. 5, 2010

(54) CONNECTION DEVICE OF AN LED LAMP AND COOLING FINS

(75) Inventor: Chien-Kuo Liang, Chung-Ho (TW)

(73) Assignee: Aeon Lighting Technology Inc., Chung-Ho, Taipei County (TW)

( * ) Notice: Subject to any disclaimer, the term of this patent is extended or adjusted under 35 U.S.C. 154(b) by 0 days.

(21) Appl. No.: 12/076,006

(22) Filed: Mar. 12, 2008

(65) Prior Publication Data

US 2010/0212859 A1 Aug. 26, 2010

(51) Int. Cl.
*F21V 29/00* (2006.01)

(52) U.S. Cl. ..... 362/294; 362/373

(58) Field of Classification Search ..... 362/547, 362/294, 373, 800
See application file for complete search history.

(56) References Cited

U.S. PATENT DOCUMENTS 6,437,469 B1 * 8/2002 Davis et al. ..... 310/64
7,097,332 B2 * 8/2006 Vamberi ..... 362/405
7,695,162 B2 * 4/2010 Zhang et al. ..... 362/294

* cited by examiner

*Primary Examiner*—Thomas M Sember
(74) *Attorney, Agent, or Firm*—Jackson IPG PLLC; Demian K. Jackson

(57) ABSTRACT

A connection device of an LED lamp and cooling fins is composed of a central tube unit, above which is connected with a ring-shape lamp seat, and below which is connected with a lower housing; and a plurality of cooling fins which are connected on surfaces of the lamp seat, the central tube unit, and a lower annular disk of the central tube unit. A sheet of each cooling fin is punched into at least one protruded member, and each protruded member of one cooling fin is abutted on a surface of the adjacent cooling fin; therefore, by the abutting of the protruded members of every two adjacent cooling fins, stability, intensity, and heat transmissibility of all the cooling fins can be improved, and spacing between every two adjacent cooling fins can be kept at a constant.

12 Claims, 7 Drawing Sheets

CONNECTION DEVICE OF AN LED LAMP AND COOLING FINS

BACKGROUND OF THE INVENTION a) Field of the Invention

The present invention relates to a connection device of an LED lamp and cooling fins, and more particularly to a connection device of an LED lamp and cooling fins which stably connects a cooling fin set without requiring another external ring member to fix the cooling fins, such that a heat transmission effect and intensity can be improved, as well as parts can be simplified to reduce cost.

b) Description of the Prior Art

A typical example of a conventional LED lamp set is disclosed by a Taiwan New Utility Model Patent No. M297441, "LED Projection Light Module." In this patent, a cooling unit is constituted by a plurality of cooling fins, with every two adjacent fins being fixed as disclosed in claim 19 and FIGS. 5 and 6 that each cooling fin is provided respectively with a top edge, a bottom edge, and an external edge at a side close to a main unit; the top edge and the bottom edge are provided respectively with a fixing hole and are extended respectively with a fixing end corresponding to outer rims of the top edge and the bottom edge. For every two adjacent cooling fins, as the fixing ends are all located at interior sides of the cooling fins, when any one cooling fin at an exterior side is loosened, it will be deformed very easily upon being subjected to an improperly force.

In a Taiwan New Utility Model Patent No. 096209554 created by the present inventor, "Cooling Device of an LED Illuminating Module," to improve stability of an entire connection of cooling fins, an exterior side of the cooling fin set is latched with a metallic outer ring. Although its advantage is to limit an entire shape of the cooling fin set, material cost of the outer ring and finishing cost upon connecting are increased. In addition, as it is not able to accurately and effectively control spacing between every two adjacent cooling fins, a heat dissipation effect will be poorer.

SUMMARY OF THE INVENTION

Accordingly, the primary object of the present invention is to provide a connection device of an LED lamp and cooling fins which is provided with high stability and improved intensity when a cooling fin set is assembled into an LED lamp seat.

Another object of the present invention is to provide a connection device of an LED lamp and cooling fins, wherein each cooling fin is provided with protruded members, enabling spacing between every two adjacent cooling fins to be controlled effectively and increasing a heat transmission effect of every two adjacent cooling fins.

Referring to FIGS. 1, 2, 5 and 6, the present invention is to provide a connection device of an LED lamp and cooling fins including a central tube unit 10, a ring-shape lamp seat 20 which is connected above the central tube unit 10 and a lower housing 30 which is connected below the central tube unit 10, with an outer diameter D1 of the ring-shape lamp seat 20 being larger than an outer diameter D (as shown in FIG. 5) of the central tube unit 10, and a maximum outer diameter D2 of a cylinder 32 at an upper end of the lower housing 30 being larger than the outer diameter D of the central tube unit 10.

Referring to FIG. 1, an upper side of an internal connection edge of each cooling fin 40 is formed with an upper L-shape connection edge 42 in a shape of a notch, a lower side is formed with a lower L-shape connection edge 44 in a shape of a notch, and a flange connection edge 46 in a shape of a protruded piece is formed between the upper and lower L-shape connection edges 42, 44, wherein the upper L-shape connection edge 42 is adhered and fixed on a side surface 25 of the lamp seat 20, the lower L-shape connection edge 44 is adhered and fixed on a circular surface 136 of a lower annular disk 13 of the central tube unit 10, and the flange connection edge 46 is adhered and fixed on a side surface 12 of the central tube unit 10. A sheet of each cooling fin 40 is punched into protruded members 45, with each protruded member 45 being abutted at a surface 41 of the adjacent cooling fin 40. Therefore, by the abutting of the protruded members 45, stability, intensity and heat transmissibility of the plural cooling fins 40 are increased. In addition, spacing between every two adjacent cooling fins 40 is kept at a constant.

Referring to FIGS. 1, 5 and 6, the upper L-shape connection edge 42 is further adhered and fixed on a bottom surface 24 of the lamp seat 20, and the lower L-shape connection edge 44 is adhered and fixed on the circular surface 136 of the lower annular disk 13 of the central tube unit 10.

Referring to FIG. 2, the protruded members 45 are in an L-shape,

Referring to FIGS. 1, 2 and 3, the upper, lower L-shape connection edges 42, 44, and the flange connection edge 46 of each cooling fin 40 are bended respectively with edges 43 (as shown in FIG. 3). The edge 43 of the upper L-shape connection edge 42 is adhered on the side surface 25 and the bottom surface 24 of the lamp seat 20, the edge 43 of the lower L-shape connection edge 44 is adhered on the lower annular disk 13 of the central tube unit 10, and the edge 43 of the flange connection edge 46 is adhered on the side surface 12 of the central tube unit 12.

Referring to FIG. 4, an internal chamber 22 of the lamp seat 20 is provided with an LED illuminating device 50; a reflection hood 55, a central through-hole 551 of which is provided above the LED illuminating device 50; and a lens 60 which seals the internal chamber 22.

Referring to FIGS. 2 and 3, the horizontal edges 43 of the upper, lower L-shape connection edges 42, 44 are provided respectively with a fin locking device 431 and an insertion hole 432, and the fin locking device 431 of one cooling fin 40 is inserted into the insertion hole 432 of the adjacent cooling fin 40, such that every two adjacent cooling fins 40 can be connected together and positioned without requiring another external ring member, thereby simplifying parts, lowering cost, and at a same time, enabling the connection of every two adjacent cooling fins to be more stable.

Referring to FIGS. 1 and 4, a lower side of the central tube unit 10 is integrally formed with the lower annular disk 13 in the horizontal direction, a circumference of the lower annular disk 13 is provided with at least one locking projection member 131, with two sides of the locking projection member 131 being provided with grooves 132. An upper rim of the lower housing 30 is provided respectively with at least one indentation 325, two sides of the indentation 325 are provided with convex members 324, the locking projection members 131 are locked into the indentations 325, and the convex members 324 are locked into the grooves 132. Accordingly, the lower annular disk 13 is connected on the lower housing 30 (as shown in FIG. 1).

The cylinder 32 of the lower housing 30 is completely connected and fixed into the lower L-shape connection edge 44, so as to increase a heat dissipation area of the cooling fin set 40 and improve heat dissipation efficiency.

Referring to FIG. 4, a connection piece 302 is fixed between the lower annular disk 13 of the central tube unit 10 and the lower housing 30, a center of the connection piece 302 is provided with a central through-hole 304, and a lower side of the connection piece 302 is provided respectively with pins 305 and hooks 306 (as shown in FIG. 5).

A circuit board 37 of a power supply is provided with insertion holes 371, the pins 305 are inserted into the insertion holes 371, and the hooks 306 are hooked at peripheries of the circuit board 37, allowing the circuit board 37 to be positioned at a lower side of the connection piece 302.

Referring to FIG. 4, peripheries of the lens 60 is provided with at least one hook 62, and an upper rim of an internal wall of the lamp seat 20 is provided with grooves 221, such that the hooks 62 can be locked into the grooves 221, allowing the lens 60 to press on the reflection hood 55, so as to stably position the reflection hood 55 into the internal chamber 22.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 2:
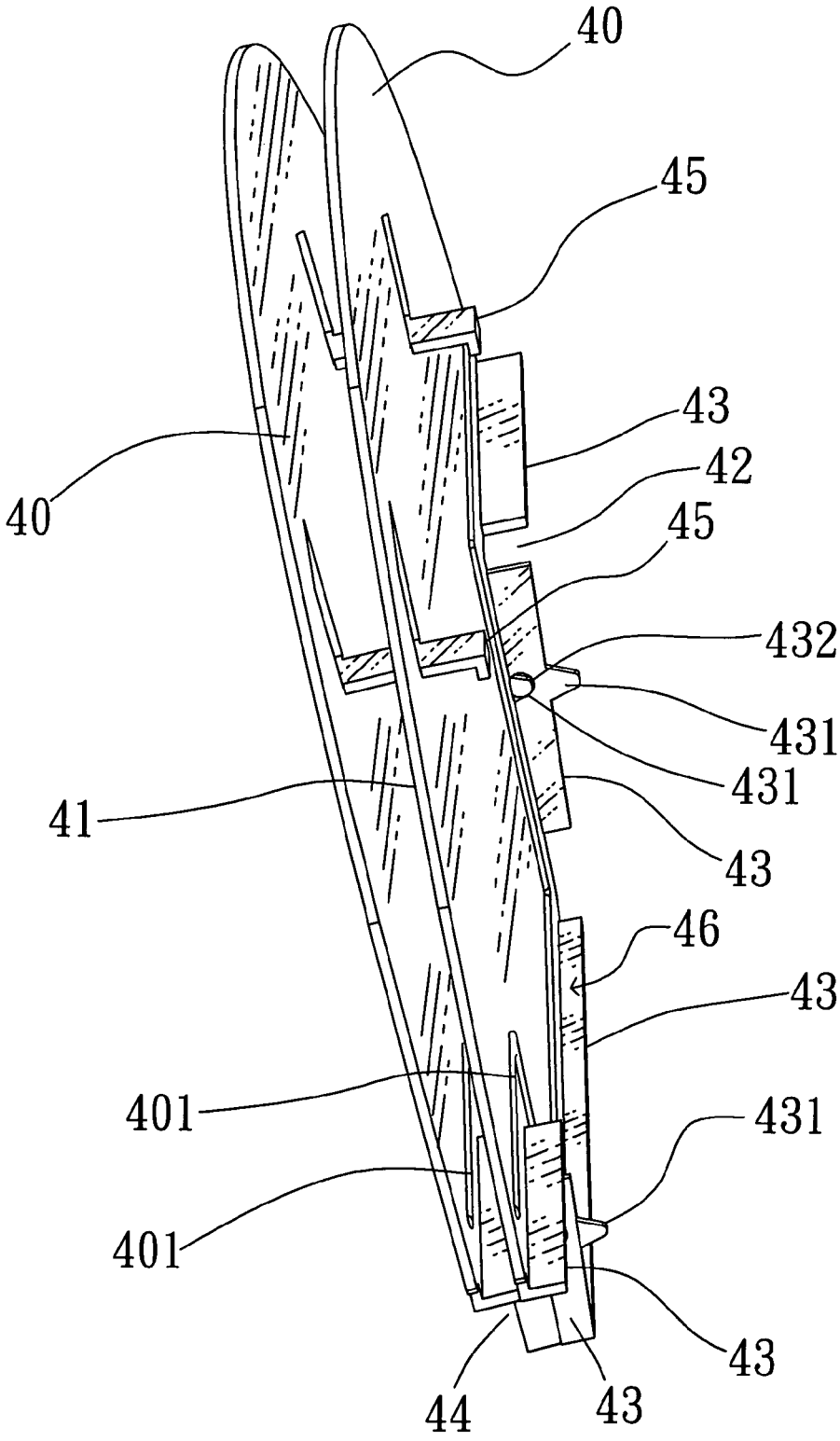
FIG. 2 shows a perspective view of the present invention with plural cooling fins being connected together.

Referring to FIG. 2, the fin locking device 431 of each cooling fin 40 is inserted into the insertion hole 432 of the adjacent cooling fin 40, and the L-shape protruded members 45 on the surface of each cooling fin 40 are abutted on the surface 41 of the adjacent cooling fin 40, such that every two adjacent cooling fins 40 can be stably connected and provided with the constant spacing for enabling a uniform cooling space, thereby improving the heat dissipation effect.

Figure 4:
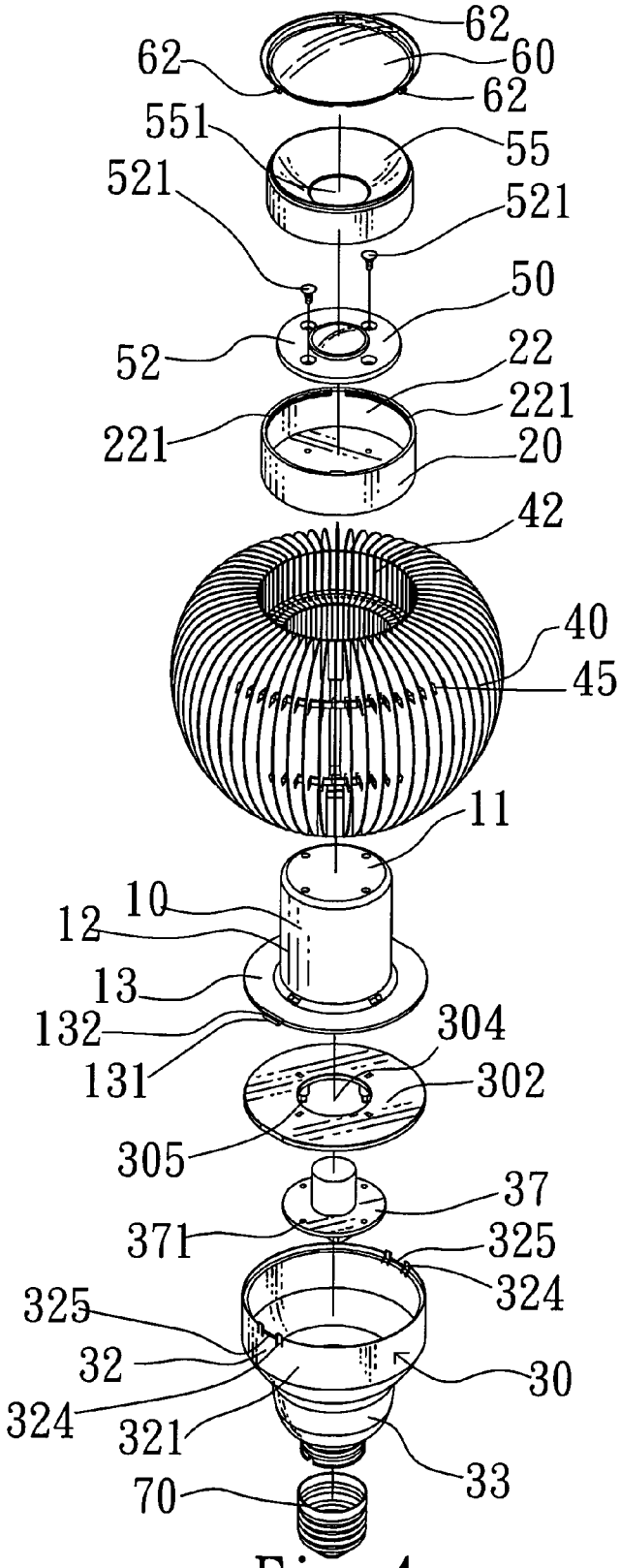
FIG. 4 shows another exploded view of parts of the present invention.

Referring to FIG. 4, it shows an exploded view of parts of the present invention, wherein a circuit board 52 of the LED illuminating device 50 is fixed at the lamp seat 20 and a top surface 11 of the central tube unit 10 with bolts 521, such that the lamp seat 20 can be fixed on the top surface 11 of the central tube unit 10. The lower side of the central tube unit 10 is integrally formed with the horizontal lower annular disk 13, and the lower side of the lower annular disk 13 is connected and fixed with the connection piece 302 which is connected with the circuit board 37 of the power supply inside the lower housing 30. The circuit board 37 is provided with the insertion holes 371, the lower surface of the connection piece 302 is provided with the pins 305 (as shown in FIG. 5), and the pins 305 are inserted and connected into the insertion holes 371, such that the connection piece 302 can be fixed with the circuit board 37.

Figure 5:
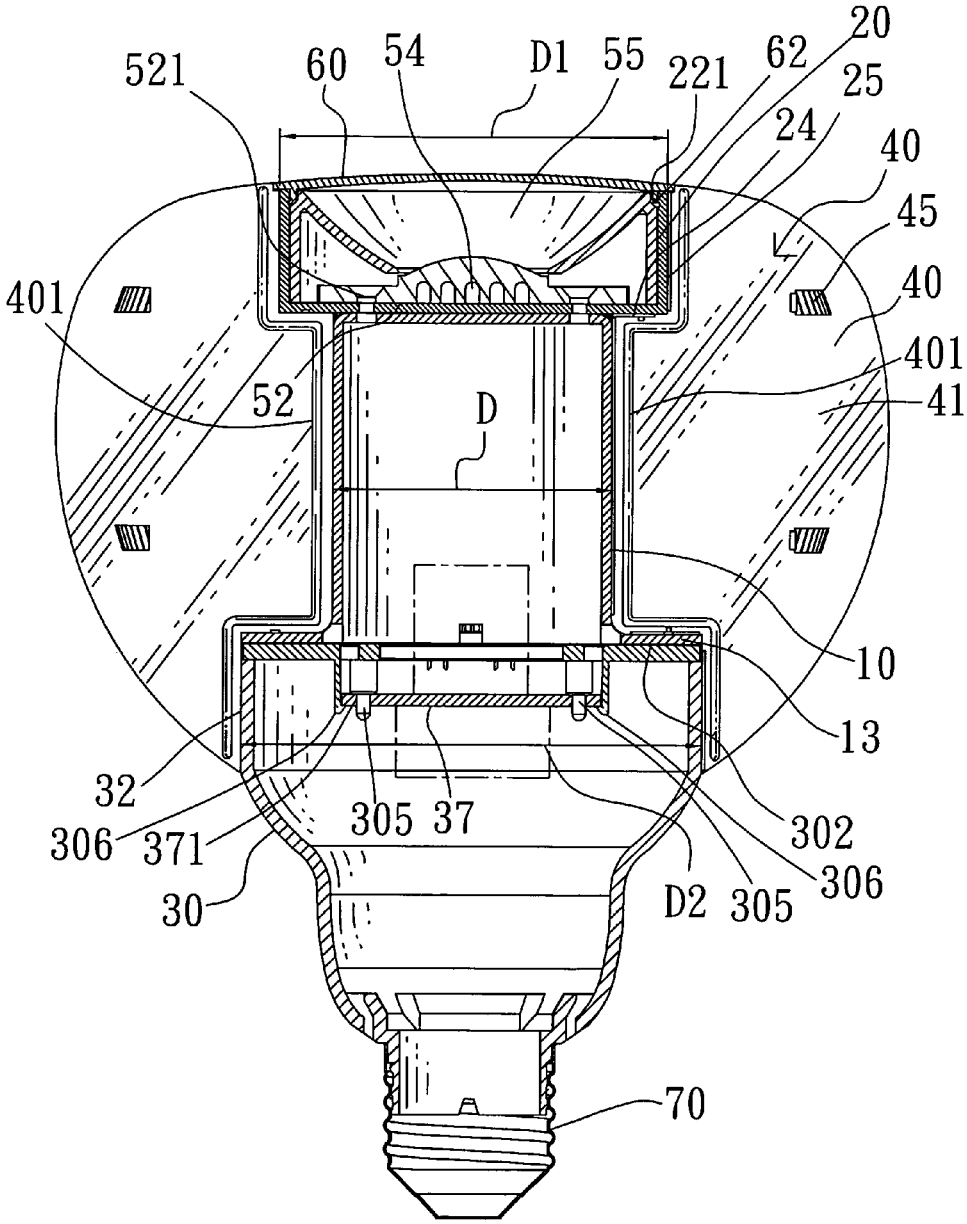
FIG. 5 shows a longitudinal cross-sectional view of the present invention.
Figure 6:
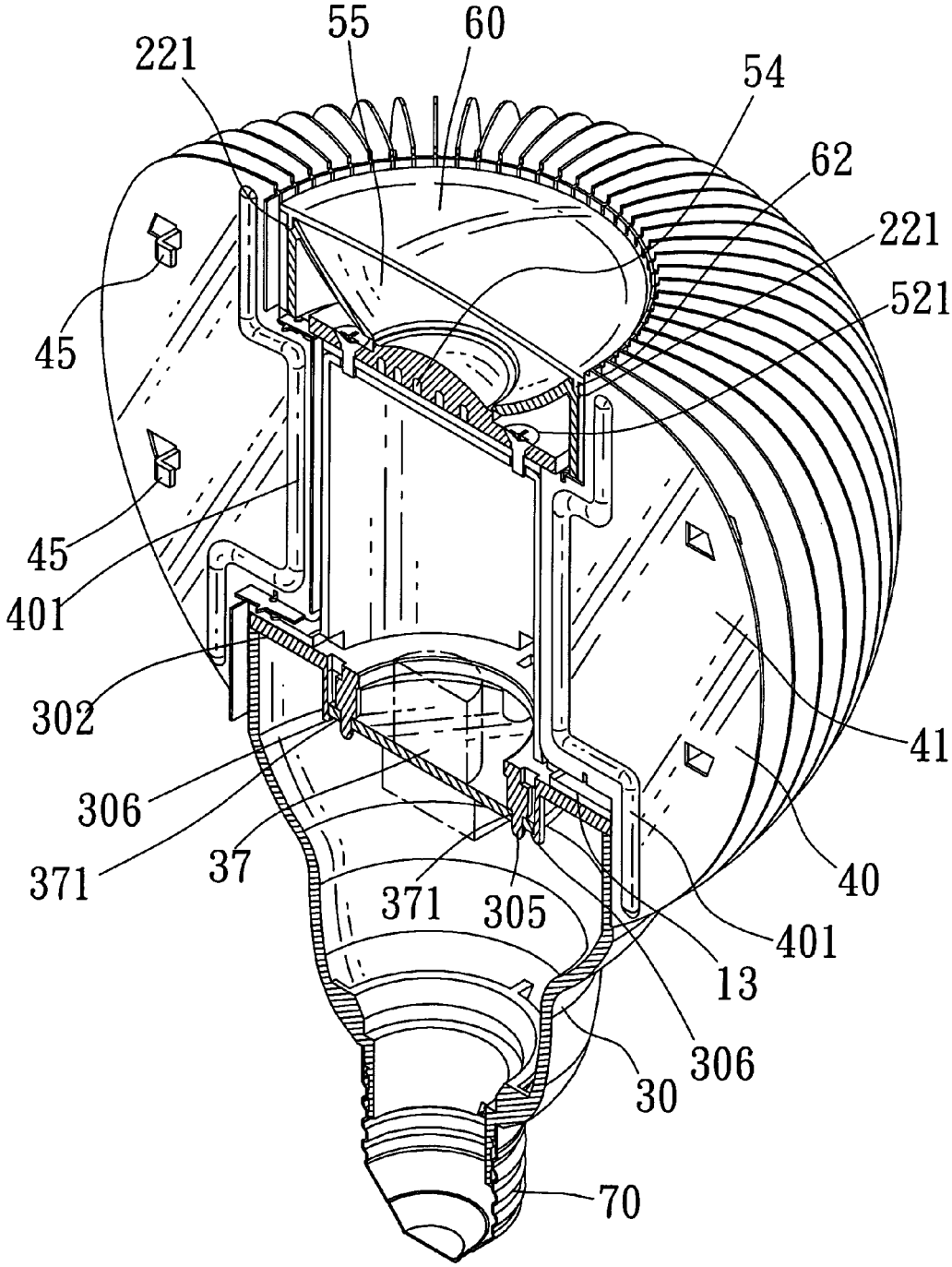
FIG. 6 shows a local exploded view and cross-sectional view of the present invention.
Figure 7:
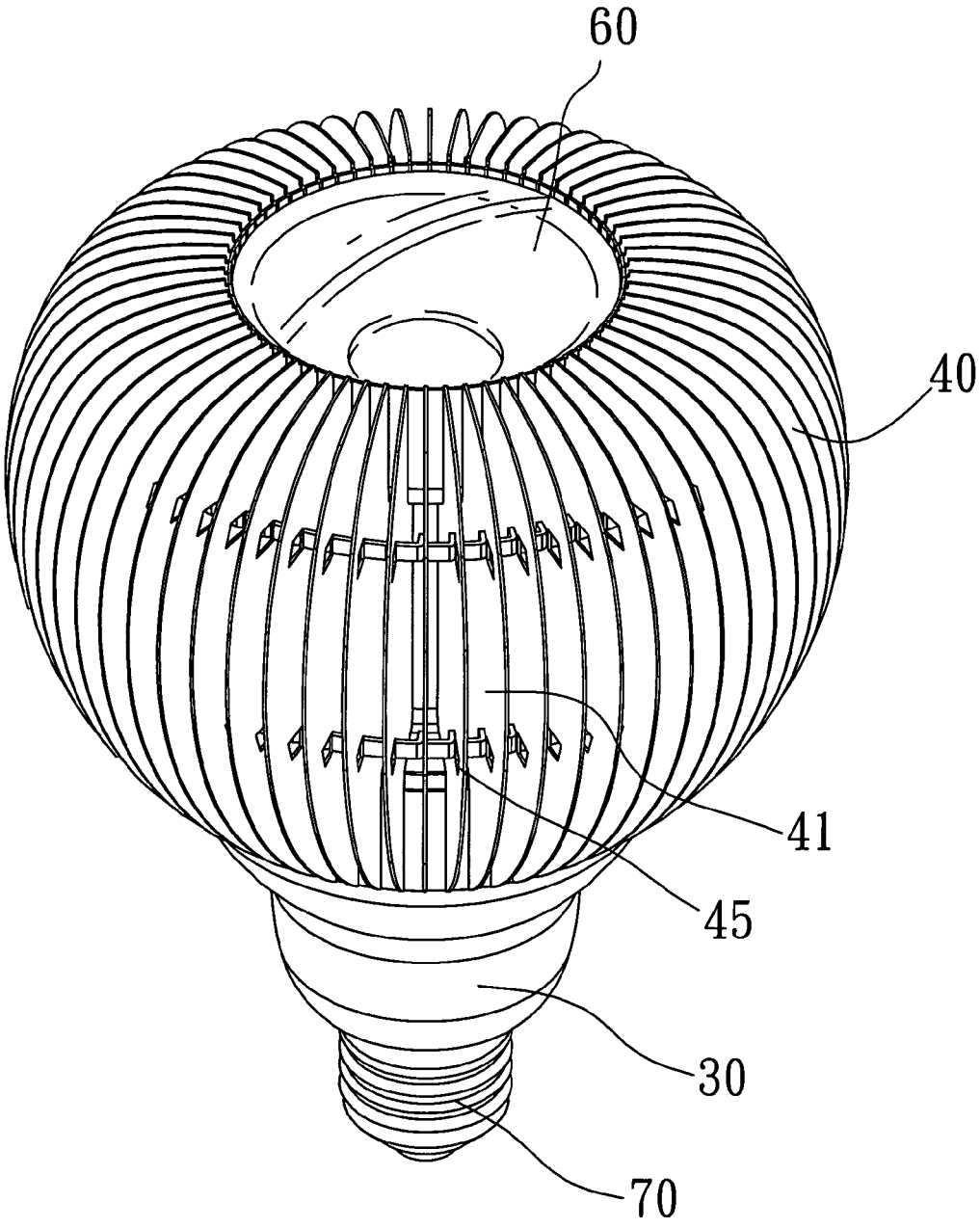
FIG. 7 shows a perspective view of the present invention after being assembled.

Referring to FIG. 5, light emitting dices 54 are welded on a center of a surface of the circuit board 52 and are packaged with resin.

Figure 1:
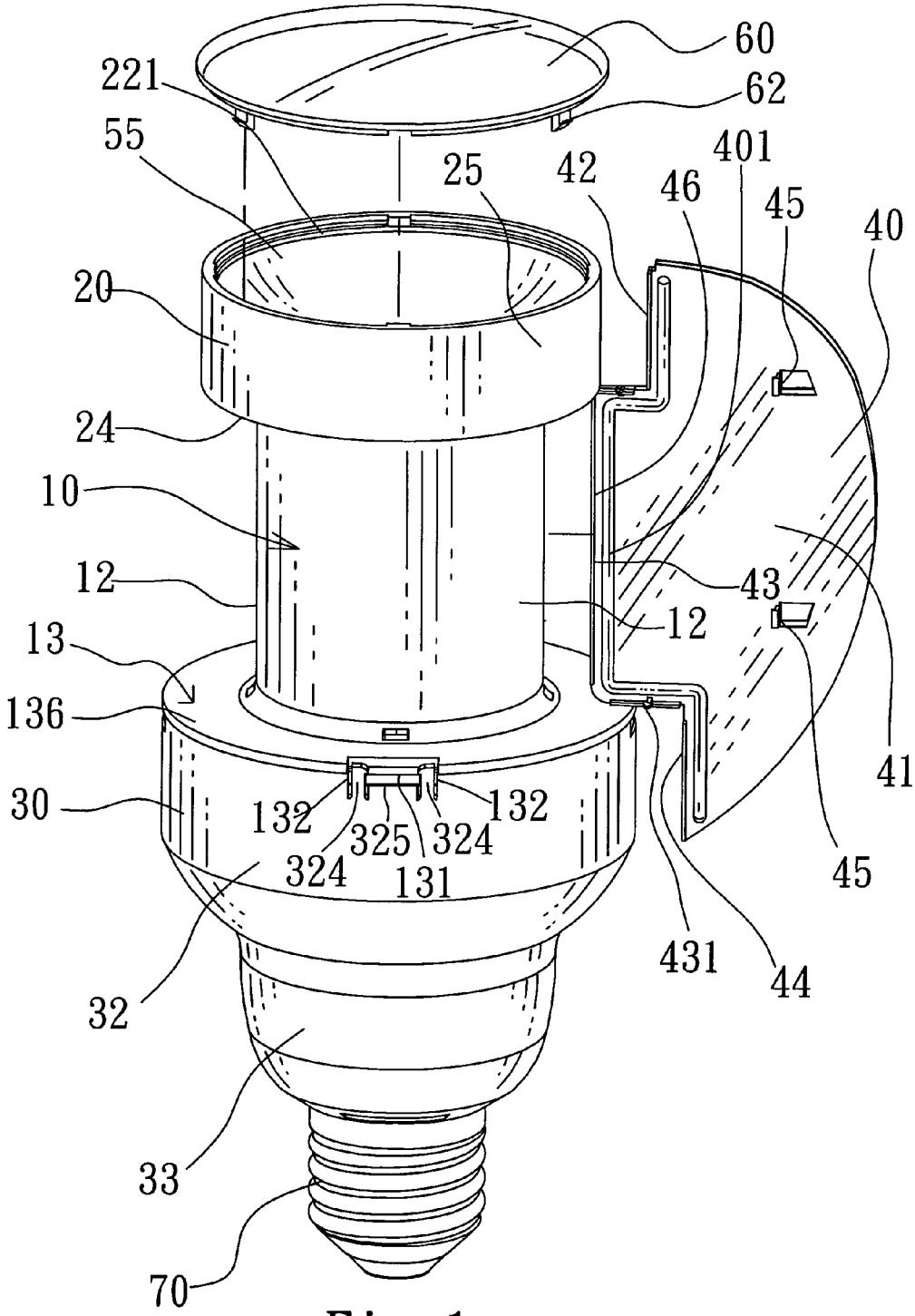
FIG. 1 shows an exploded view of parts of the present invention.
Figure 3:
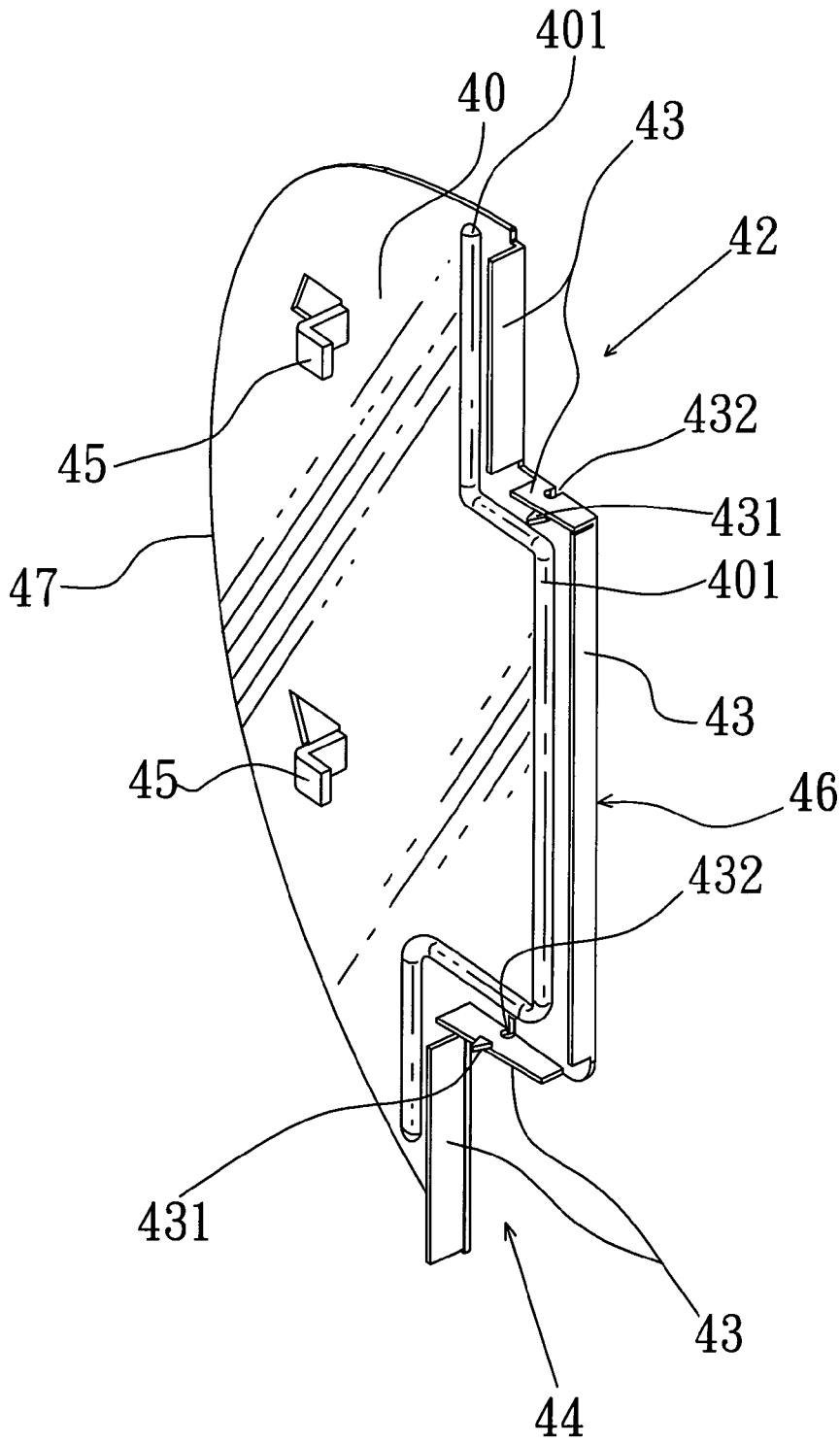
FIG. 3 shows a perspective view of a single cooling fin of the present invention.

Referring to FIGS. 2 and 3, the upper, lower L-shape connection edges 42, 44, and the flange connection edge 46 of each cooling fin 40 are punched respectively into the edges 43. As shown in FIGS. 4 and 5, the edges 43 are adhered on the side surface 12 of the central tube unit 10, the surface 136 of the lower annular disk 13, as well as the side surface 25 and the bottom surface 24 of the lamp seat 20 (as shown in FIG. 1) with aluminum paste or epoxy resin. As the edges 43 are provided with a certain width, areas of adherence will be enlarged, so as to increase the heat dissipation efficiency of each cooling fin 40 and the stability of connecting the cooling fin 40 at the central tube unit 10, the lamp seat 20, and the lower housing 30.

Referring to FIG. 4, the peripheries of the lens 60 are provided with the hooks 62, and the upper rim of the internal wall of the lamp seat 20 is provided with the grooves 221, such that the hooks 62 can be locked into the grooves 221, allowing the lens 60 to press on the reflection hood 55 which can be stably positioned into the internal chamber 22. Accordingly, a shortcoming of a prior art wherein glue or other adherent is used to join the refection hood 55 with the lens 60 can be improved.

Referring to FIGS. 1 and 3, a surface of each cooling fin 40 is punched outward with a protruded rib 401 for improving the intensity to support the external force of each cooling fin 40, and at a same time, for covering the aluminum paste or epoxy resin that is spilled out by pressing the edge 43 and the side surface 12 of the central tube unit 10.

Moreover, as shown in FIG. 5, the cylinder 32 of the lower housing 30 is completely connected and fixed into the lower L-shape connection edge 44; therefore, the heat dissipation area of the cooling fin set 40 is increased so as to increase the heat dissipation efficiency.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A connection device of an LED lamp and cooling fins, comprising a central tube unit, above which is connected with a ring-shape lamp seat, and below which is connected with a lower housing; a plurality of cooling fins, connection edges in an internal side of each cooling fin which are fixed on surfaces of the lamp seat, the central tube unit, and a lower annular disk of the central tube unit, with a sheet of each cooling fin being punched into at least one protruded member, each protruded member being abutted on a surface of the adjacent cooling fin, such that by the abutting of the protruded members for every two adjacent cooling fins, stability, intensity, and heat transmissibility of all the cooling fins are improved, and spacing between every two adjacent cooling fins is kept at a constant.

2. The connection device of an LED lamp and cooling fins according to claim 1, wherein a lower side of the central tube unit is integrally formed with a horizontal lower annular disk, a circumference of which is provided with at least one locking projection member, with two sides of the locking projection member being provided with grooves; an upper rim of the lower housing being provided respectively with at least one indentation, two sides of the indentation being provided with convex members, the locking projection members being locked into the indentations, and the convex members being locked into the grooves, such that the lower annular disk is connected on the lower housing.

3. The connection device of an LED lamp and cooling fins according to claim 1, wherein a connection piece is fixed between the lower annular disk of the central tube unit and the lower housing, a center of the connection piece is provided with a central through-hole, and a lower side of the connection piece is provided respectively with pins and hooks; a circuit board which is provided with insertion holes, with the pins being inserted into the insertion holes, and the hooks being locked at peripheries of the circuit board, allowing the circuit board to be positioned and fixed below the connection piece.

4. The connection device of an LED lamp and cooling fins according to claim 1, wherein a surface of each cooling fin is punched outward into a protruded rib.

5. A connection device of an LED lamp and cooling fins, comprising a central tube unit, above which is connected with a ring-shape lamp seat, and below which is connected with a lower housing, with an outer diameter of the ring-shape lamp seat being larger than an outer diameter of the central tube unit, and a maximum outer diameter of a cylinder at an upper end of the lower housing being larger than the outer diameter of the central tube unit; a plurality of cooling fins, an upper side of a connection edge in an internal side of each cooling fin being formed with an upper L-shape connection edge in a shape of a notch, a lower side being formed with a lower L-shape connection edge in a shape of a notch, and a flange connection edge in a shape of a protruded piece being formed between the upper and lower L-shape connection edges, wherein the upper L-shape connection edge is adhered and fixed on a side surface of the lamp seat, the lower L-shape connection edge is adhered and fixed on a surface of a lower annular disk of the central tube unit, the flange connection edge is adhered and fixed on a side surface of the central tube unit, and a sheet of each cooling fin is punched into at least one protruded member, with each protruded member being abutted on a surface of the adjacent cooling fin, such that by the abutting of the protruded members for every two adjacent cooling fins, stability, intensity, and heat transmissibility of all cooling fins are improved, and spacing between every two adjacent cooling fins is kept at a constant.

6. The connection device of an LED lamp and cooling fins according to claim 1 or claim 5, wherein the protruded member is in an L-shape or other shape.

7. The connection device of an LED lamp and cooling fins according to claim 1 or claim 5, wherein an internal chamber of the lamp seat is provided with an LED illuminating device; a reflection hood, a center of which is provided with a central through-hole that is above the LED illuminating device; and a lens which seals the internal chamber.

8. The connection device of an LED lamp and cooling fins according to claim 5 or claim 7, wherein peripheries of the lens are provided with at least one hook, an upper rim of an internal wall of the lamp seat is provided with grooves, and hooks are locked into the grooves, allowing the lens to press on the reflection hood to stably position the reflection hood into the internal chamber.

9. The connection device of an LED lamp and cooling fins according to claim 5, wherein the upper L-shape connection edge is further adhered and fixed on a bottom surface of the lamp seat, and the lower L-shape connection edge is adhered and fixed on a surface of the lower annular disk of the central tube unit.

10. The connection device of an LED lamp and cooling fins according to claim 5, wherein the upper, lower L-shape connection edges and the flange connection edge of each cooling fin are bended respectively with edges, the edge of the upper L-shape connection edge is adhered at the side surface and the bottom surface of the lamp seat, the edge of the lower L-shape connection edge is adhered on the lower annular disk of the central tube unit, and the edge of the flange connection edge is adhered on the side surface of the central tube unit.

11. The connection device of an LED lamp and cooling fins according to claim 5, wherein the horizontal edges of the upper and lower L-shape connection edges are provided respectively with a fin locking device and an insertion hole, and the fin locking device of one cooling fin is inserted into the insertion hole of the adjacent cooling fin, such that every two adjacent cooling fins are connected together and positioned.

12. The connection device of an LED lamp and cooling fins according to claim 5, wherein the cylinder of the lower housing is completely connected and fixed into the lower L-shape connection edge to increase a heat dissipation area of the cooling fin and improve heat dissipation efficiency.

* * * * *